US010317078B2

(12) United States Patent
Cunha et al.

(10) Patent No.: US 10,317,078 B2
(45) Date of Patent: Jun. 11, 2019

(54) COOLING A MULTI-WALLED STRUCTURE OF A TURBINE ENGINE

(71) Applicant: United Technologies Corporation, Farmington, CT (US)

(72) Inventors: Frank J. Cunha, Avon, CT (US); Stanislav Kostka, Jr., Shrewsbury, MA (US)

(73) Assignee: United Technologies Corporation, Farmington, CT (US)

( * ) Notice: Subject to any disclaimer, the term of this patent is extended or adjusted under 35 U.S.C. 154(b) by 74 days.

(21) Appl. No.: 15/034,702

(22) PCT Filed: Nov. 21, 2014

(86) PCT No.: PCT/US2014/066880

§ 371 (c)(1),
(2) Date: May 5, 2016

(87) PCT Pub. No.: WO2015/077600

PCT Pub. Date: May 28, 2015

(65) Prior Publication Data

US 2016/0273772 A1 Sep. 22, 2016

Related U.S. Application Data

(60) Provisional application No. 61/907,228, filed on Nov. 21, 2013.

(51) Int. Cl.

| | |
|---|---|
| ***F23R 3/10*** | (2006.01) |
| ***F23R 3/06*** | (2006.01) |
| ***F23R 3/00*** | (2006.01) |

(52) U.S. Cl.

CPC ..... *F23R 3/002* (2013.01); *F23R 3/005* (2013.01); *F23R 3/06* (2013.01); *F05D 2240/15* (2013.01); *F05D 2260/201* (2013.01); *F23R 3/10* (2013.01); *F23R 2900/03044* (2013.01)

(58) Field of Classification Search

CPC .... F23R 3/002; F23R 3/06; F23R 3/10; F23R 3900/03044; F23R 2900/03044; F05D 2240/15; F05D 2260/201

See application file for complete search history.

(56) References Cited

U.S. PATENT DOCUMENTS

| | | | | |
|---|---|---|---|---|
| 4,265,085 | A | 5/1981 | Fox et al. | |
| 4,901,522 | A | 2/1990 | Commaret et al. | |
| 5,461,866 | A | 10/1995 | Sullivan et al. | |
| 5,542,246 | A * | 8/1996 | Johnson | F23R 3/10 60/755 |
| 5,758,503 | A | 6/1998 | DuBell et al. | |
| 6,029,455 | A | 2/2000 | Sandelis | |
| 6,470,685 | B2 | 10/2002 | Pidcock et al. | |

(Continued)

OTHER PUBLICATIONS

EP search report for EP14863469.4 dated Dec. 19, 2016.

*Primary Examiner* — Steven M Sutherland
*Assistant Examiner* — James P McGlynn
(74) *Attorney, Agent, or Firm* — O'Shea Getz P.C.

(57) ABSTRACT

An assembly is provided for a turbine engine. This turbine engine assembly includes a body, a shell and a heat shield panel. The panel is attached to the shell with a tapered cooling cavity between the shell and the panel. The panel defines a cooling aperture configured to direct air out of the cooling cavity to impinge against the body.

8 Claims, 13 Drawing Sheets

(56) References Cited

U.S. PATENT DOCUMENTS

| | | | | |
|---|---|---|---|---|
| 7,093,441 | B2 | 8/2006 | Burd et al. | |
| 7,146,815 | B2 | 12/2006 | Burd | |
| 7,827,800 | B2 * | 11/2010 | Stastny | F23R 3/002 60/39.11 |
| 7,849,694 | B2 * | 12/2010 | Dahlke | F23M 5/02 60/752 |
| 8,443,610 | B2 | 5/2013 | Hoke et al. | |
| 2001/0029738 | A1 | 10/2001 | Pidcock et al. | |
| 2007/0245742 | A1 * | 10/2007 | Dahlke | F02K 1/82 60/754 |
| 2008/0131262 | A1 | 6/2008 | Lee et al. | |
| 2009/0077974 | A1 | 3/2009 | Dahlke et al. | |
| 2010/0287941 | A1 | 11/2010 | Kim et al. | |
| 2011/0185735 | A1 | 8/2011 | Snyder | |
| 2011/0185740 | A1 * | 8/2011 | Dierberger | F23M 5/02 60/755 |
| 2013/0247575 | A1 | 9/2013 | Patel et al. | |

* cited by examiner

COOLING A MULTI-WALLED STRUCTURE OF A TURBINE ENGINE

This application claims priority to PCT Patent Application No. PCT/US14/066880 filed Nov. 21, 2014 which claims priority to U.S. Patent Application No. 61/907,228 filed Nov. 21, 2013, which are hereby incorporated herein by reference in their entireties.

BACKGROUND OF THE INVENTION

1. Technical Field

This disclosure relates generally to a turbine engine and, more particularly, to cooling a multi-walled structure of a turbine engine.

2. Background Information

A floating wall combustor for a turbine engine typically includes a bulkhead, an inner combustor wall and an outer combustor wall. The bulkhead extends radially between the inner and the outer combustor walls. Each combustor wall includes a shell and a heat shield that defines a respective radial side of a combustion chamber. Cooling cavities extend radially between the heat shield and the shell. These cooling cavities fluidly couple impingement apertures defined in the shell with effusion apertures defined in the heat shield.

During turbine engine operation, the impingement apertures direct cooling air from a plenum adjacent the combustor into the cooling cavities to impingement cool the heat shield. The effusion apertures direct the cooling air from the cooling cavities into the combustion chamber to film cool the heat shield. This cooling air subsequently mixes and reacts with a fuel-air mixture within the combustion chamber, thereby leaning out the fuel-air mixture in both an upstream fuel-rich primary zone and a downstream fuel-lean secondary zone. The primary zone of the combustion chamber is located between the bulkhead and the secondary zone, which is generally axially aligned with quench apertures in the combustor walls.

In an effort to increase turbine engine efficiency and power, temperature within the combustion chamber may be increased. However, increasing the temperature in the primary zone with a relatively lean fuel-air mixture may also increase NOx, CO and unburned hydrocarbon (UHC) emissions.

There is a need in the art for an improved turbine engine combustor.

SUMMARY OF THE DISCLOSURE

According to an aspect of the invention, an assembly is provided for a turbine engine. This turbine engine assembly includes a body, a shell and a heat shield panel. The panel is attached to the shell with a tapered cooling cavity between the shell and the panel. The panel defines a cooling aperture configured to direct air out of the cooling cavity to impinge against the body.

According to another aspect of the invention, another assembly is provided for a turbine engine. This turbine engine assembly includes a body, a shell and a heat shield panel. The panel is attached to the shell with a cooling cavity vertically between the shell and the panel. The panel includes a rail and defines a plurality of cooling apertures, at the rail, through which substantially all air within the cooling cavity is directed out of the cooling cavity to impinge against the body.

The cooling aperture may be one of a plurality of cooling apertures defined by the panel and configured to direct air out of the cooling cavity to impinge against the body.

Substantially all air entering the cooling cavity may be directed out of the cooling cavity through the cooling apertures.

The body may define a plurality of second cooling apertures through which air is directed towards the panel. The cooling apertures may be circumferentially offset from the second cooling apertures.

The panel may include a rail that partially defines the cooling cavity. The panel may define the cooling aperture at the rail. The rail may at least partially define the cooling aperture. The panel may also include a base that may partially define the cooling cavity. The base may also or alternatively at least partially define the cooling aperture.

A surface of the shell and a surface of the panel may converge towards one another and vertically define at least a portion of the cooling cavity.

The body may be configured as or otherwise include a combustor bulkhead.

The body may be configured as or otherwise include a second heat shield panel that is attached to the shell.

The turbine engine assembly may include a second body. The panel may further define a second cooling aperture configured to direct air from a second cooling cavity between the shell and the panel to impinge against the second body.

The second cooling aperture may be one of a plurality of second cooling apertures defined by the panel and configured to direct air out of the second cooling cavity to impinge against the second body.

The body may be configured as or otherwise include a combustor bulkhead. In addition or alternatively, the second body may be configured as or otherwise include a second heat shield panel.

The body may define a plurality of second cooling apertures through which air is directed towards the panel. The cooling apertures may be circumferentially offset from the second cooling apertures.

The rail may at least partially define one or more of the cooling apertures.

The panel may include a base that partially defines the cooling cavity. The base may also at least partially define one or more of the cooling apertures.

The body may be configured as or otherwise include a combustor bulk head or a second heat shield panel.

The foregoing features and the operation of the invention will become more apparent in light of the following description and the accompanying drawings.

DETAILED DESCRIPTION OF THE INVENTION

Figure 1:
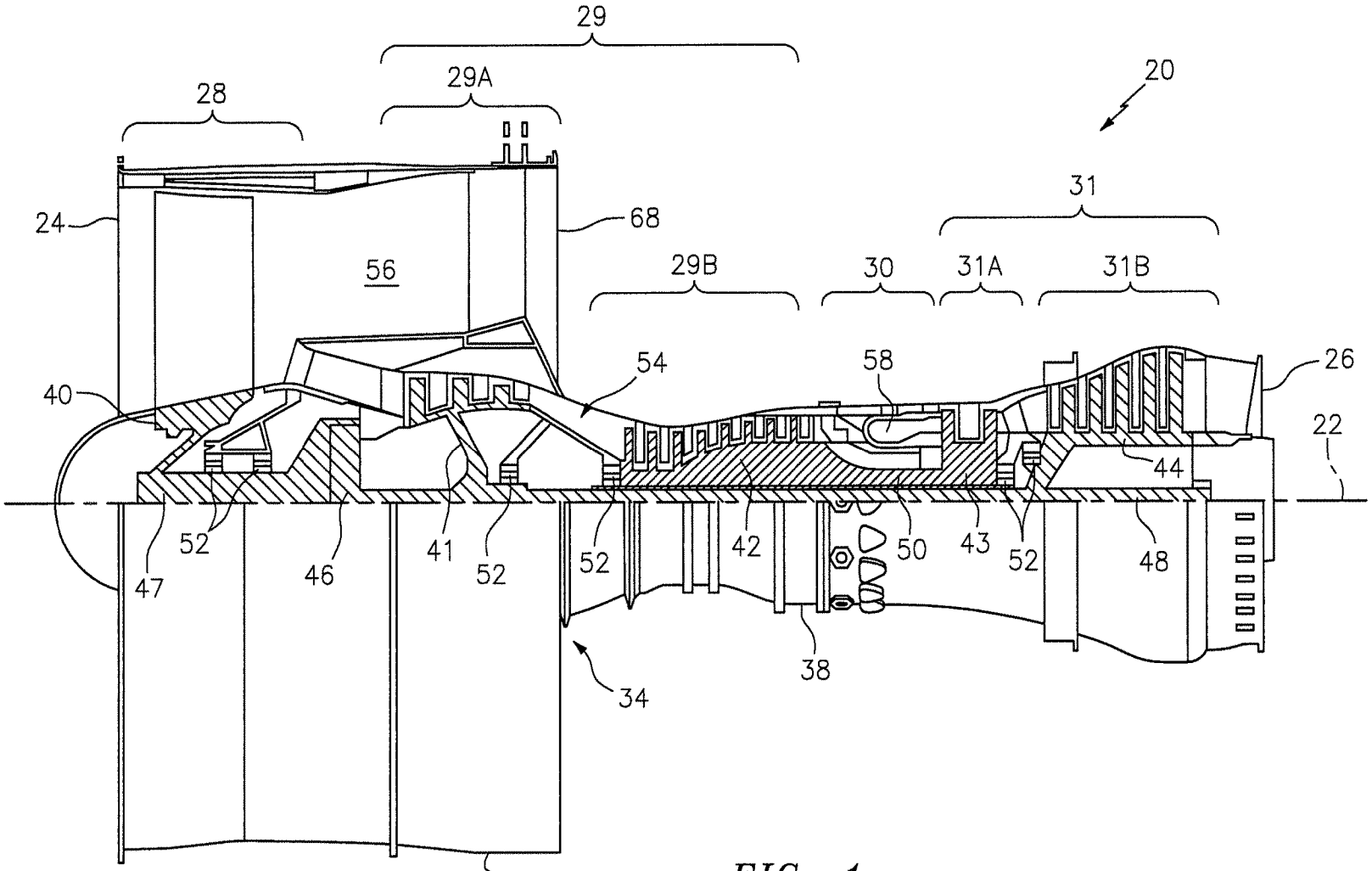
FIG. 1 is a side cutaway illustration of a geared turbine engine.

FIG. 1 is a side cutaway illustration of a geared turbine engine 20. This turbine engine 20 extends along an axial centerline 22 between a forward airflow inlet 24 and an aft airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B. The engine sections 28-31 are arranged sequentially along the centerline 22 within an engine housing 34, which includes a first engine case 36 and a second engine case 38.

Each of the engine sections 28, 29A, 29B, 31A and 31B includes a respective rotor 40-44. Each of the rotors 40-44 includes a plurality of rotor blades arranged circumferentially around and connected to (e.g., formed integral with or mechanically fastened, welded, brazed, adhered or otherwise attached to) one or more respective rotor disks. The fan rotor 40 is connected to a gear train 46 through a fan shaft 47. The gear train 46 and the LPC rotor 41 are connected to and driven by the LPT rotor 44 through a low speed shaft 48. The HPC rotor 42 is connected to and driven by the HPT rotor 43 through a high speed shaft 50. The shafts 47, 48 and 50 are rotatably supported by a plurality of bearings 52. Each of the bearings 52 is connected to the second engine case 38 by at least one stationary structure such as, for example, an annular support strut.

Air enters the turbine engine 20 through the airflow inlet 24, and is directed through the fan section 28 and into an annular core gas path 54 and an annular bypass gas path 56. The air within the core gas path 54 may be referred to as "core air". The air within the bypass gas path 56 may be referred to as "bypass air".

The core air is directed through the engine sections 29-31 and exits the turbine engine 20 through the airflow exhaust 26. Within the combustor section 30, fuel is injected into a combustion chamber 58 and mixed with the core air. This fuel-core air mixture is ignited to power the turbine engine 20 and provide forward engine thrust. The bypass air is directed through the bypass gas path 56 and out of the turbine engine 20 through a bypass nozzle 60 to provide additional forward engine thrust. Alternatively, the bypass air may be directed out of the turbine engine 20 through a thrust reverser to provide reverse engine thrust.

Figure 2:
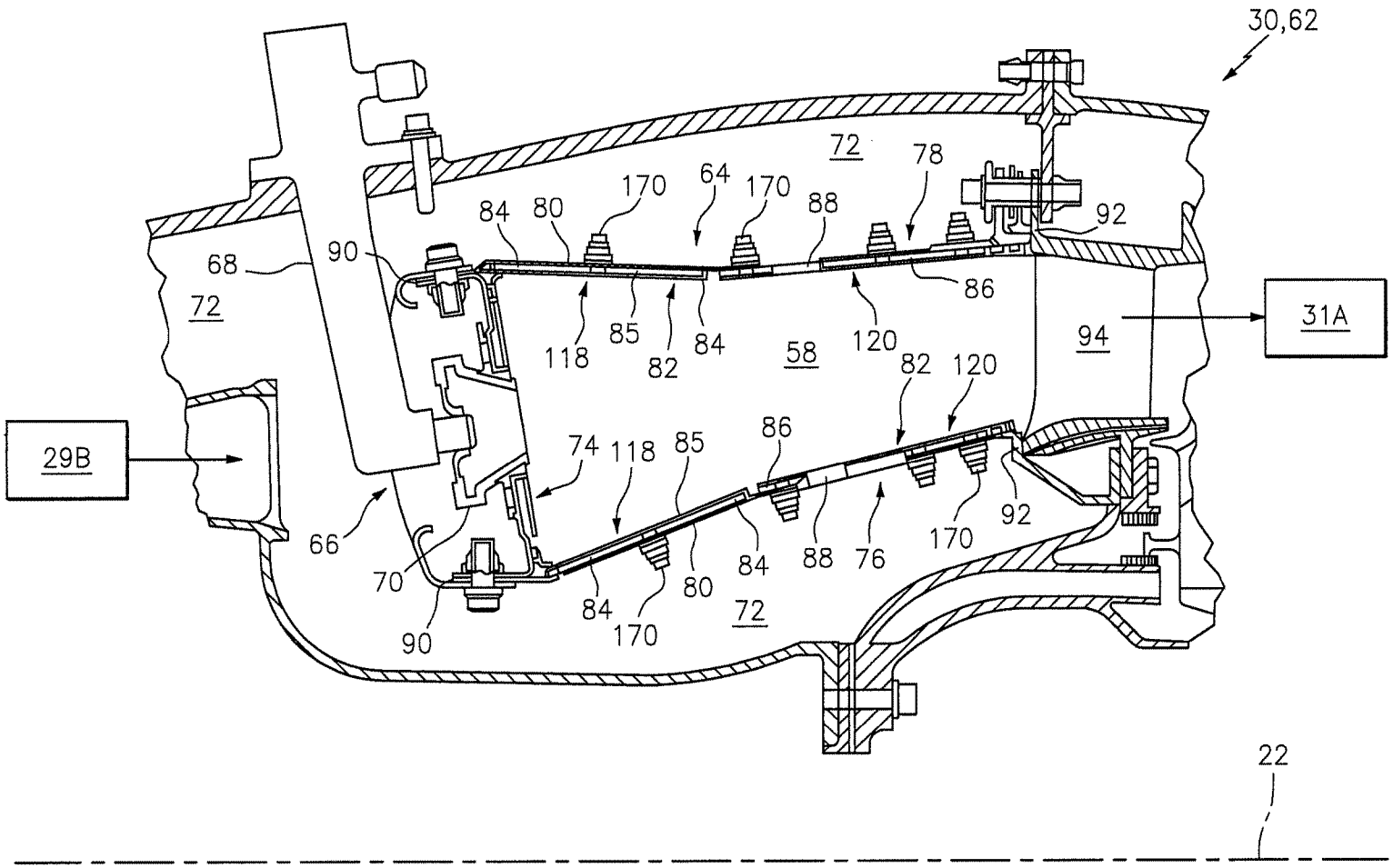
FIG. 2 is a side cutaway illustration of a portion of a combustor section.

FIG. 2 illustrates an assembly 62 of the turbine engine 20. This turbine engine assembly 62 includes a combustor 64. The turbine engine assembly 62 also includes one or more fuel injector assemblies 66, each of which may include a fuel injector 68 mated with a swirler 70.

The combustor 64 may be configured as an annular floating wall combustor arranged within an annular plenum 72 of the combustor section 30. The combustor 64 of FIGS. 2 and 3, for example, includes an annular combustor bulkhead 74, a tubular combustor inner wall 76, and a tubular combustor outer wall 78. The bulkhead 74 extends radially between and is connected to the inner wall 76 and the outer wall 78. The inner wall 76 and the outer wall 78 each extends axially along the centerline 22 from the bulkhead 74 towards the turbine section 31A, thereby defining the combustion chamber 58.

Figure 4:
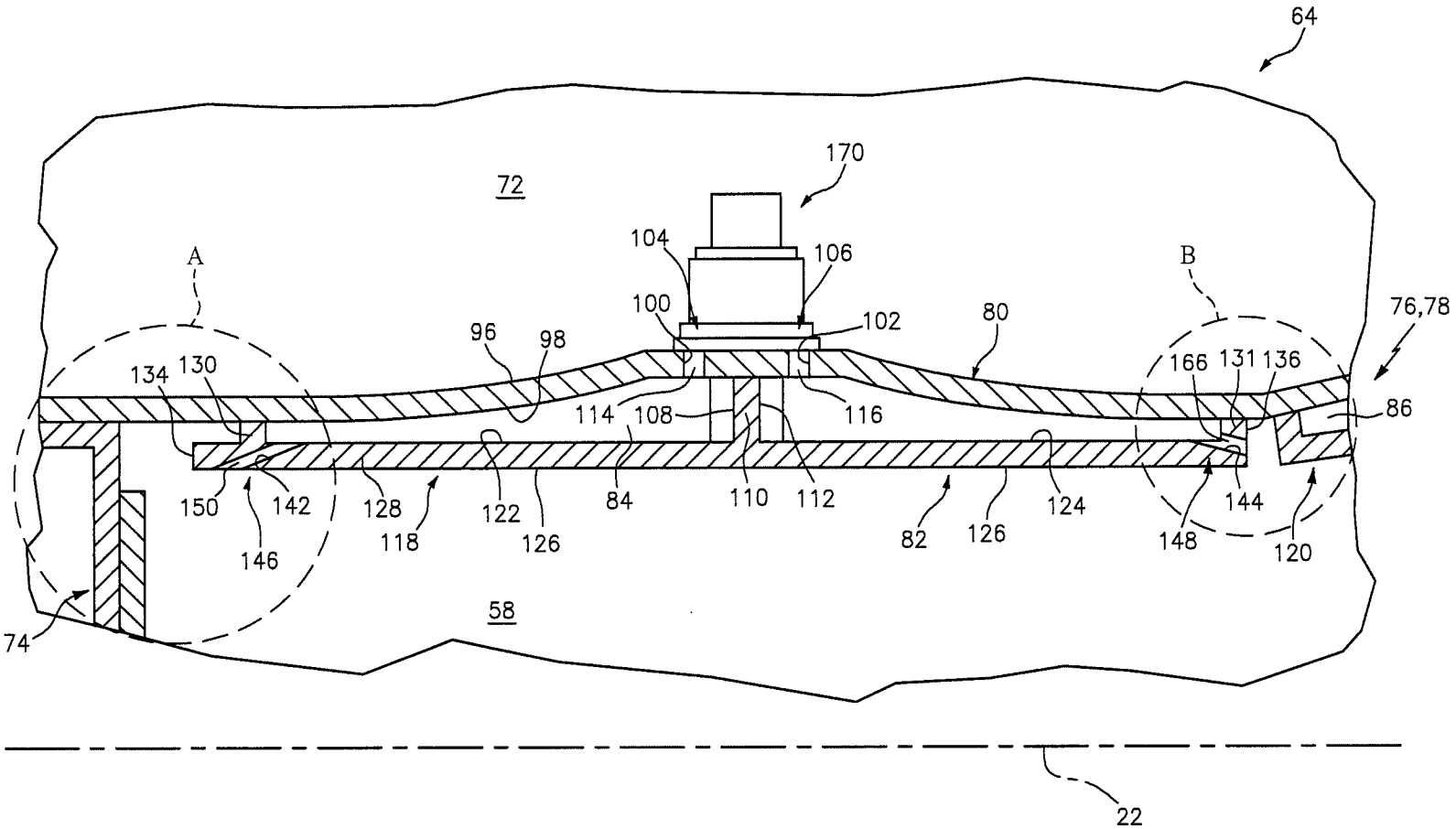
FIG. 4 is a side sectional illustration of a portion of the combustor at a first circumferential position.
Figure 5:
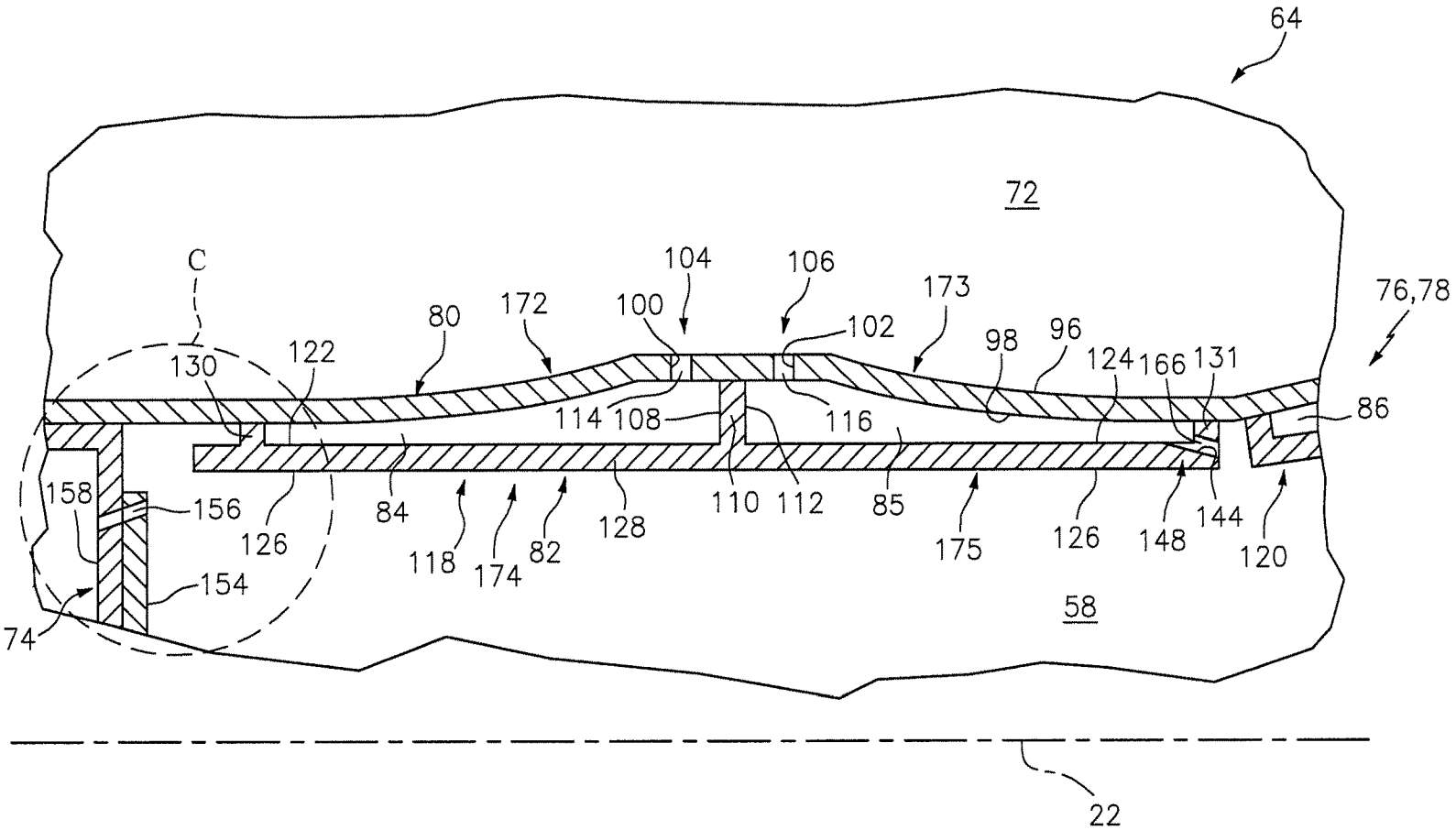
FIG. 5 is a side sectional illustration of the combustor of FIG. 4 at a second circumferential position.
Figure 6:
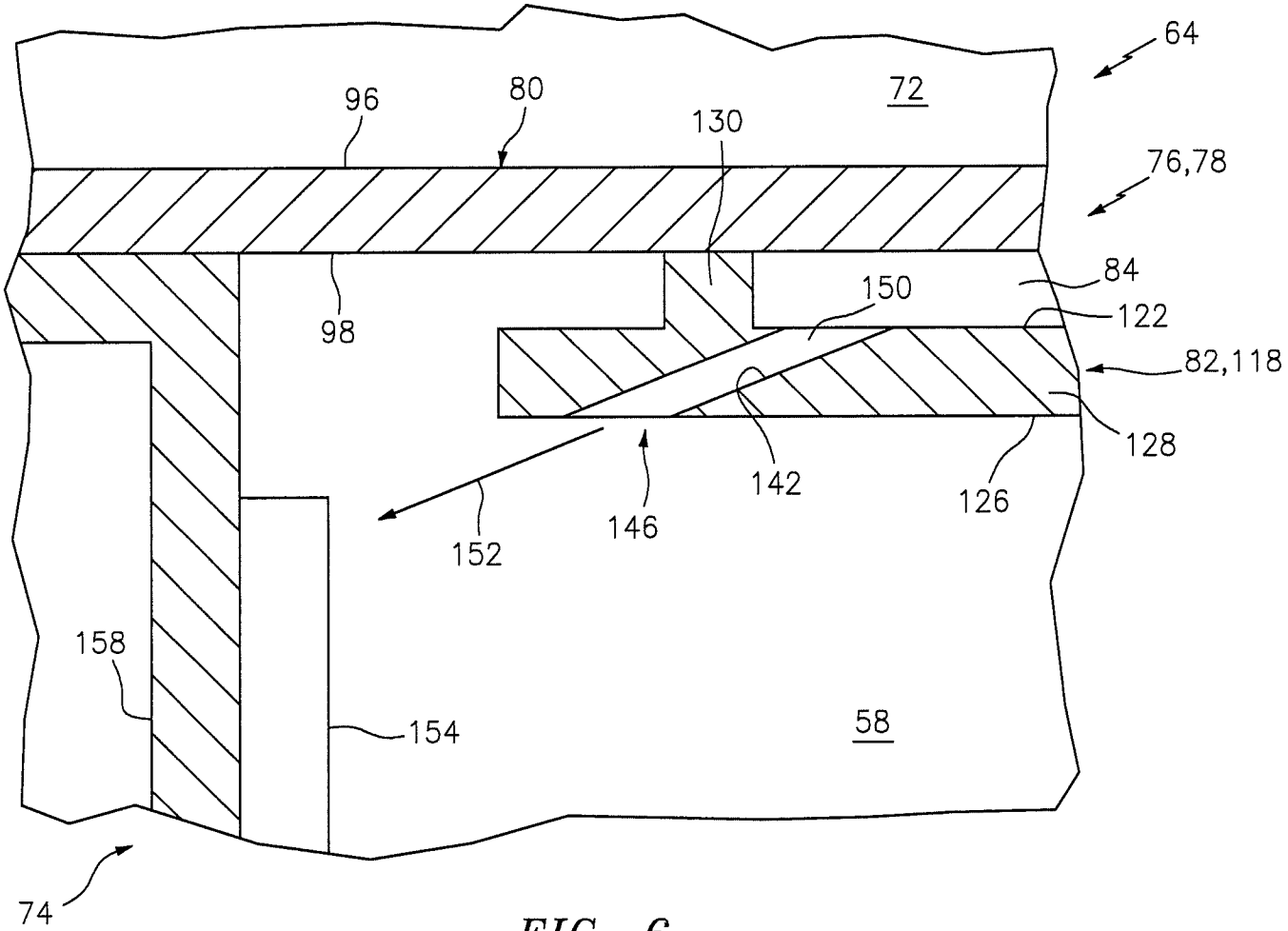
FIG. 6 is an enlarged side sectional illustration of a portion A of the combustor of FIG. 4.
Figure 7:
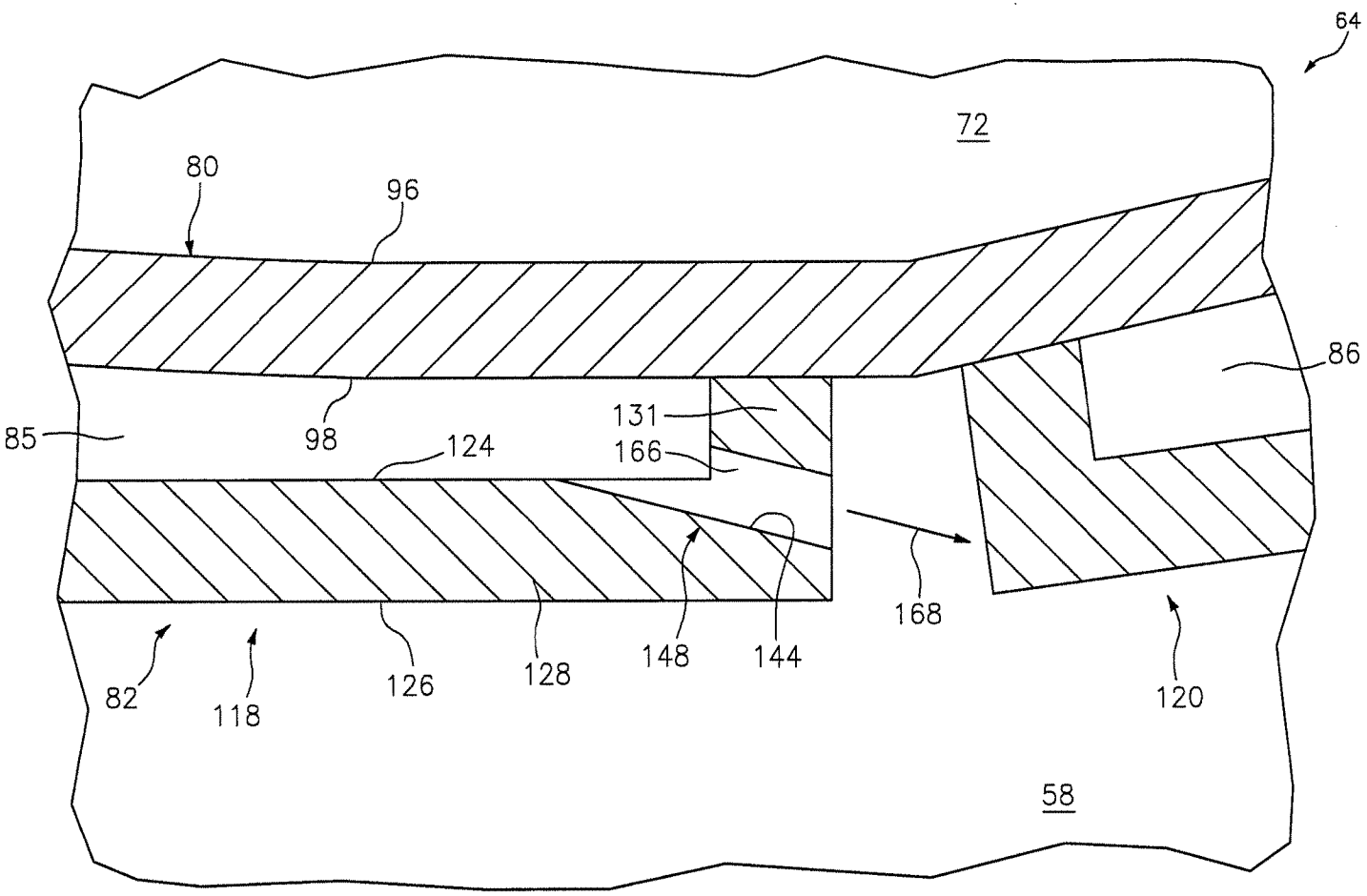
FIG. 7 is an enlarged side sectional illustration of a portion B of the combustor of FIG. 4.
Figure 8:
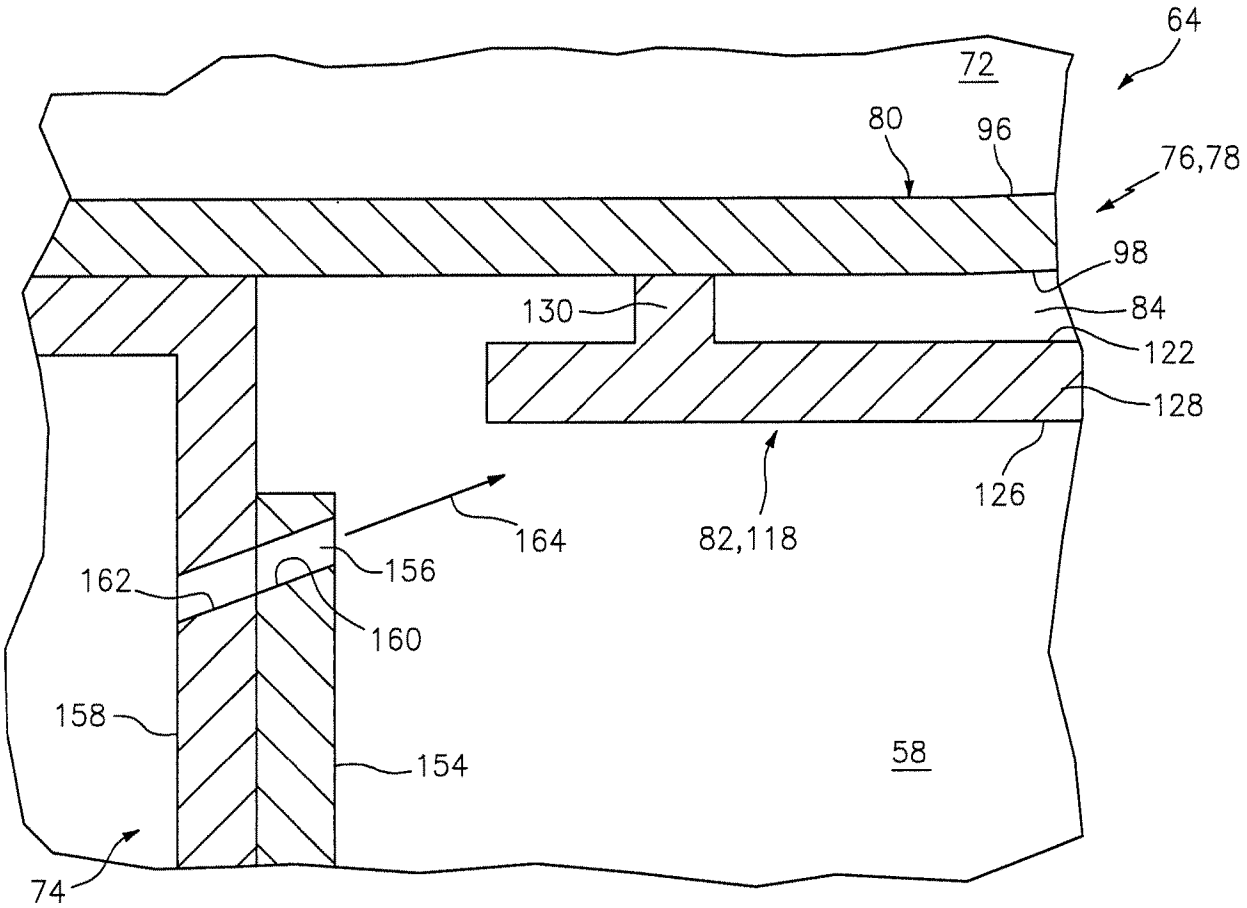
FIG. 8 is an enlarged side sectional illustration of a portion C of the combustor of FIG. 5.

FIG. 4 is a side sectional illustration of a portion of the combustor 64 at a first circumferential position. FIG. 5 is a side sectional illustration of the combustor 64 portion of FIG. 4 at a second circumferential position. FIG. 6 is an enlarged side sectional illustration of a portion A of the combustor 64 of FIG. 4. FIG. 7 is an enlarged side sectional illustration of a portion B of the combustor 64 of FIG. 4. FIG. 8 is an enlarged side sectional illustration of a portion C of the combustor 64 of FIG. 5.

Figure 3:
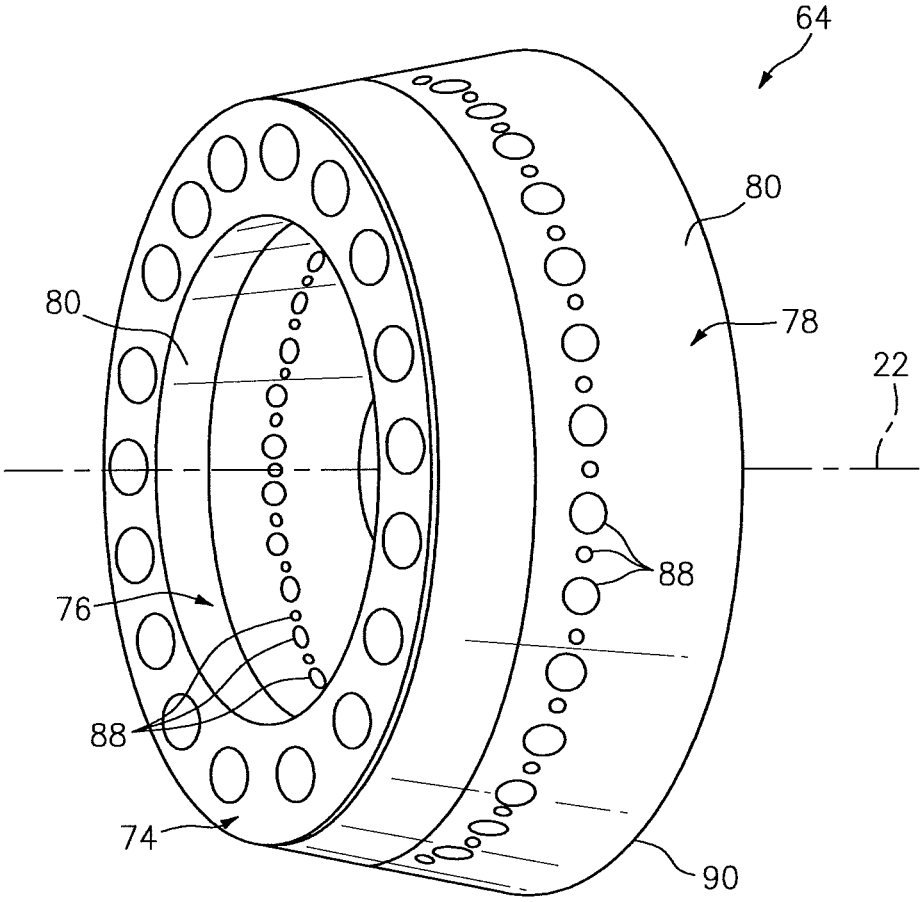
FIG. 3 is a perspective illustration of a portion of a combustor.

The inner wall 76 and the outer wall 78 may each be configured as a multi-walled structure; e.g., a hollow dual-walled structure. The inner wall 76 and the outer wall 78 of FIGS. 2 and 4, for example, each includes a tubular combustor shell 80, a tubular combustor heat shield 82, and one or more cooling cavities 84-86 (e.g., impingement cavities). Referring now to FIGS. 2 and 3, the inner wall 76 and the outer wall 78 may also each include one or more quench apertures 88, which extend through the wall 76, 78 and are disposed circumferentially around the centerline 22.

Referring to FIG. 2, the shell 80 extends circumferentially around the centerline 22. The shell 80 extends axially along the centerline 22 between an axial forward end 90 and an axial aft end 92. The shell 80 is connected to the bulkhead 74 at the forward end 90. The shell 80 may be connected to a stator vane assembly 94 or the HPT section 31A at the aft end 92.

Referring to FIG. 4, the shell 80 has a plenum surface 96, a cavity surface 98 and one or more aperture surfaces 100 and 102 (see also FIG. 5). At least a portion of the shell 80 extends radially between the plenum surface 96 and the cavity surface 98. The plenum surface 96 defines a portion of the plenum 72. The cavity surface 98 defines a portion of one or more of the cavities 84-86 (see FIG. 2).

The aperture surfaces 100 and 102 (see FIG. 4) may be respectively arranged in one or more aperture arrays 104 and 106. The apertures surfaces 100, 102 in each aperture array 104, 106 may be disposed circumferentially around the centerline 22. The aperture surfaces 100 in the first aperture array 104 may be located proximate (or adjacent) to and on a first axial side 108 of a respective heat shield rail 110 (e.g., intermediate rail). The aperture surfaces 102 in the second aperture array 106 may be located proximate (or adjacent) to and on an opposite second axial side 112 of the respective heat shield rail 110.

Each of the aperture surfaces 100, 102 defines a respective cooling aperture 114, 116. Each cooling aperture 114, 116 extends (e.g., radially) through the shell 80 from the plenum surface 96 to the cavity surface 98. Each cooling aperture 114, 116 may be configured as an impingement aperture. Each aperture surface 100, 102 of FIG. 4, for example, is configured to direct a jet of cooling air to impinge substantially perpendicularly against the heat shield 82.

Referring to FIG. 2, the heat shield 82 extends circumferentially around the centerline 22. The heat shield 82 extends axially along the centerline 22 between an axial forward end and an axial aft end. The forward end is located at an interface between the wall 76, 78 and the bulkhead 74. The aft end may be located at an interface between the wall 76, 78 and the stator vane assembly 94 or the HPT section 31A.

The heat shield 82 may include one or more heat shield panels 118 and 120, one or more of which may have an arcuate geometry. The panels 118 and 120 are respectively arranged at discrete locations along the centerline 22. The panels 118 are disposed circumferentially around the centerline 22 and form a forward hoop. The panels 120 are disposed circumferentially around the centerline 22 and form an aft hoop. Alternatively, the heat shield 82 may be configured from one or more tubular bodies.

Figure 9:
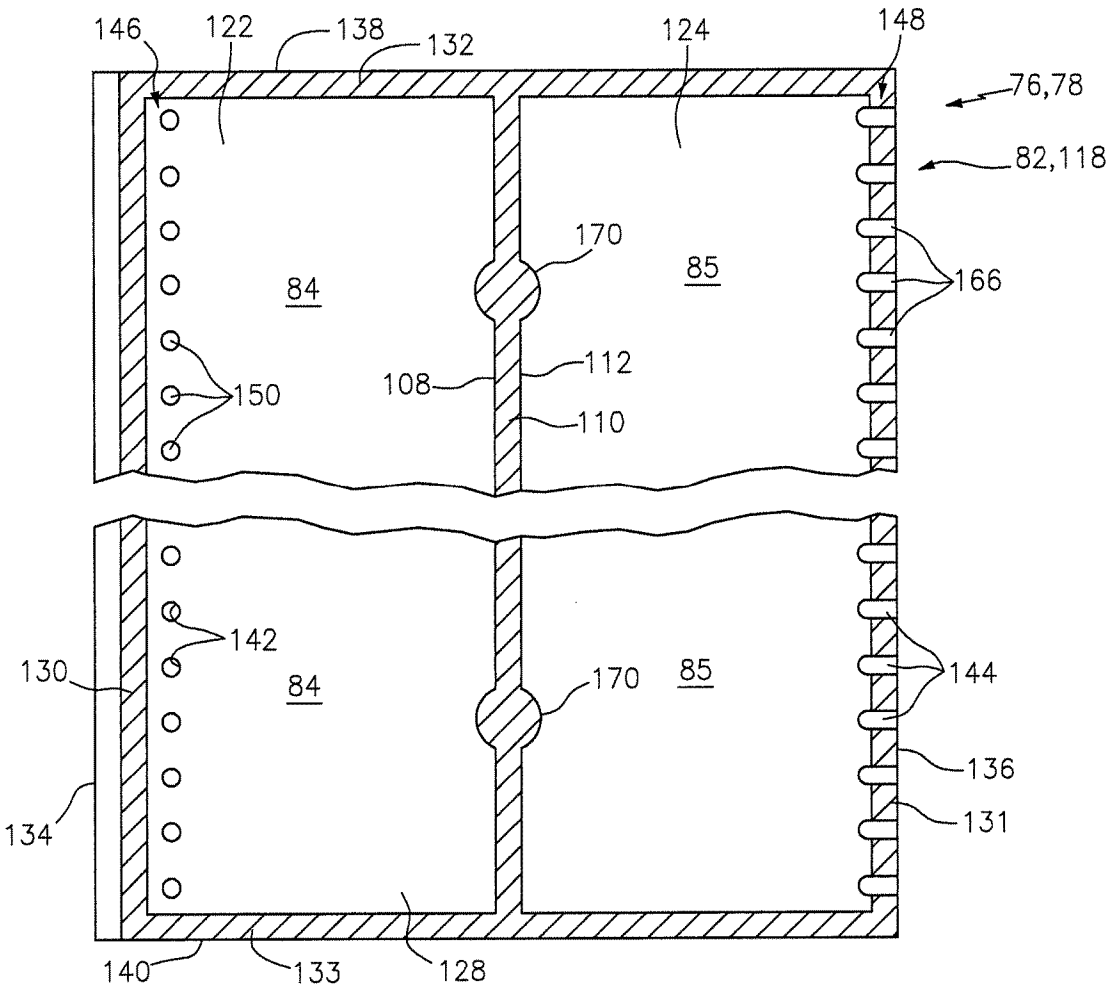
FIG. 9 is a circumferential sectional illustration of a portion of a heat shield panel included in the combustor of FIG. 4.

Referring to FIGS. 4 and 9, each of the panels 118 has one or more cavity surfaces 122 and 124 and a chamber surface 126. At least a portion of the panel 118 extends radially between the cavity surfaces 122 and 124 and the chamber surface 126. Each cavity surface 122 defines at least one side of a respective one of the cooling cavities 84. Each cavity surface 124 defines at least one side of a portion of a respective one of the cooling cavities 85. It will be appreciated that the chamber surface 126 similarly defines at least one side of a portion of the combustion chamber 58.

For example, each panel 118 may include a panel base 128 and one or more rails (e.g., rails 110 and 130-133) with the panel base 128 and the panel rails 110, 130, 132 and 133 collectively defining cavity surface 122. Similarly, the panel base 128 and the panel rails 110 and 131-133 may collectively define cavity surface 124, and the panel base 128 may define the chamber surface 126.

The panel base 128 may be configured as a generally curved (e.g., arcuate) plate. The panel base 128 extends axially between an axial forward end 134 and an axial aft end 136. The panel base 128 extends circumferentially between opposing circumferential ends 138 and 140.

The panel rails may include the axial intermediate rail 110, one or more axial end rails 130 and 131, and one more circumferential end rails 132 and 133. Each of the panel rails 110 and 130-133 of the inner wall 76 extends radially in from the respective panel base 128; see also FIG. 2. Each of the panel rails 110 and 130-133 of the outer wall 78 extends radially out from the respective panel base 128; see also FIG. 2.

The axial intermediate and end rails 110, 130 and 131 extend circumferentially between and are connected to the circumferential end rails 132 and 133. The axial intermediate rail 110 is disposed axially (e.g., centrally) between the axial end rails 130 and 131. The axial end rail 130 is arranged at the forward end 134. The axial end rail 131 is arranged at the aft end 136. The circumferential end rail 132 is arranged at the circumferential end 138. The circumferential rail 133 is arranged at the circumferential end 140.

Still referring to FIGS. 4 and 9, each panel 118 may also have one or more aperture surfaces 142 and 144. These aperture surfaces 142 and 144 may be respectively arranged in one or more aperture arrays 146 and 148. The aperture surfaces 142, 144 in each array 146, 148 may be disposed circumferentially around the centerline 22. Respective aperture surfaces 142 in the forward array 146 may be adjacent (or in or proximate) the respective axial end rail 130 (see also FIG. 6). Respective aperture surfaces 144 in the aft array 148 may be in (or adjacent or proximate) the respective axial end rail 131 (see also FIG. 7).

Figure 10:
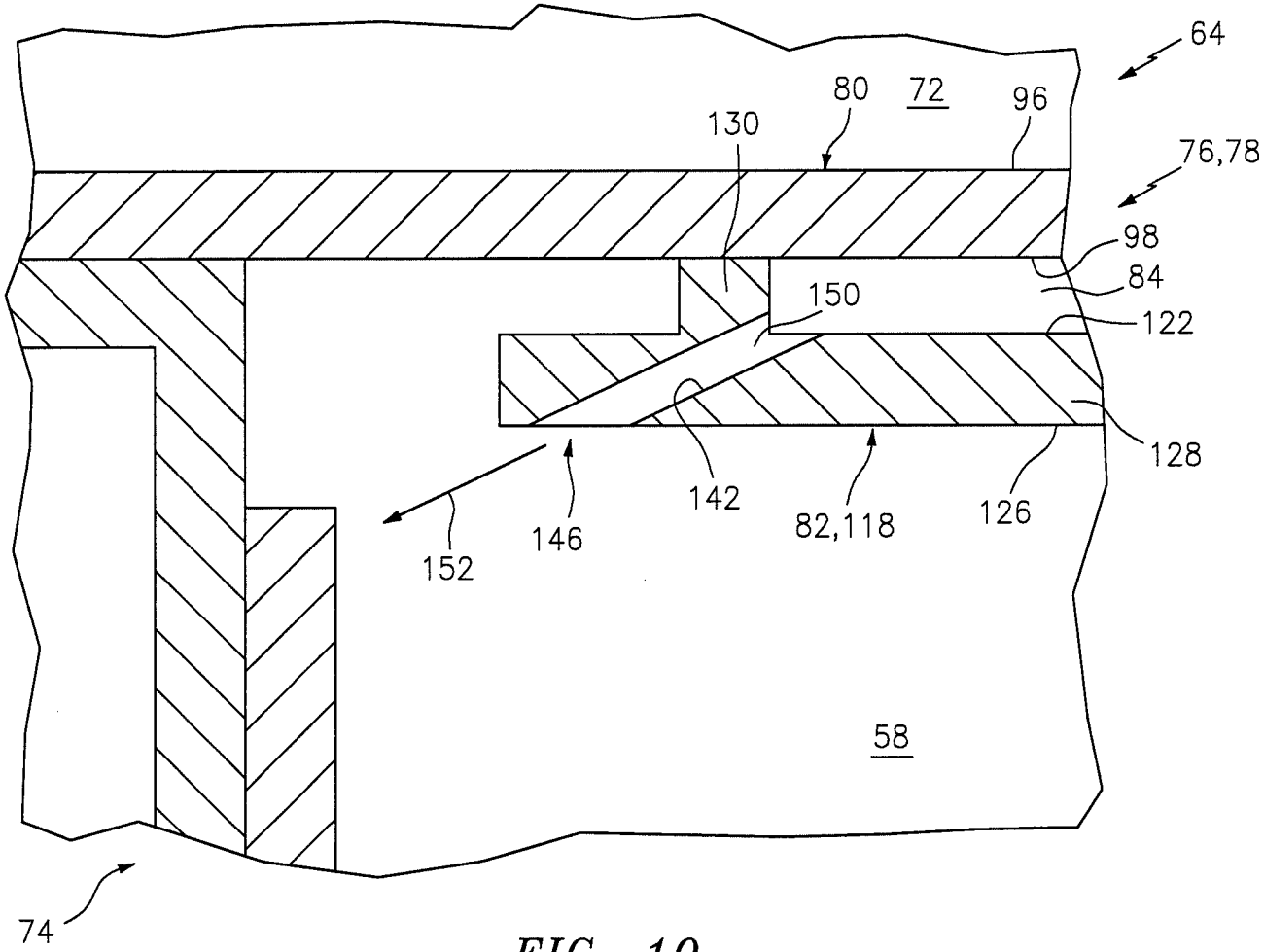
FIGS. 10-13 are side sectional illustrations of respective portions of alternate embodiment combustors.
Figure 11:
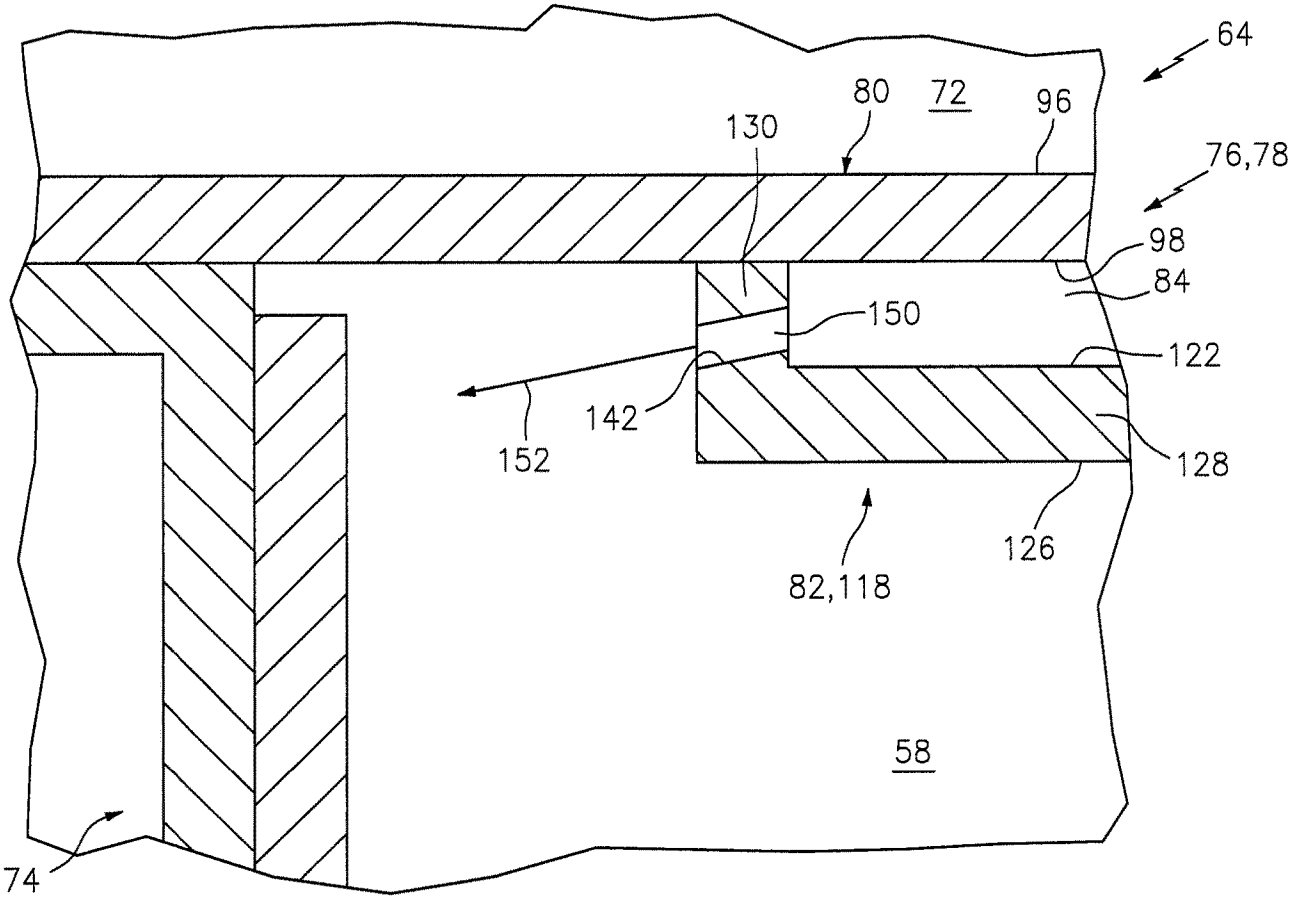

Referring to FIG. 6, each of the aperture surfaces 142 defines a cooling aperture 150 in the panel 118 and, thus, the heat shield 82. Each cooling aperture 150 may extend radially and axially (and/or circumferentially) through the panel base 128. Alternatively, referring to FIG. 10, one or more of the cooling apertures 150 may extend radially and axially (and/or circumferentially) through and be defined in the panel base 128 as well as the axial end rail 130. Referring to FIG. 11, one or more of the cooling apertures 150 may also or alternatively extend axially (and/or circumferentially) through and be defined in the axial end rail 130.

Referring again to FIG. 6, one or more of the cooling apertures 150 may each be configured as an impingement aperture. Each aperture surface 142 of FIG. 6, for example, is configured to direct a jet of cooling air along a respective trajectory 152 to impinge against a body such as, for example, a heat shield 154 of the bulkhead 74.

Referring to FIGS. 6 and 8, the cooling apertures 150 may be laterally (e.g., circumferentially offset) with respect to an array of one or more cooling apertures 156 defined in the bulkhead 74 to reduce or prevent air directed from the apertures 150 and 156 from colliding and directly mixing. Each cooling aperture 150, for example, may be circumferentially centered between two adjacent cooling apertures 156, and vice versa. Each cooling aperture 156 may extend radially and axially (and/or circumferentially) through the heat shield 154 and a shell 158 of the bulkhead 74. Each cooling aperture 156 may be configured as an impingement aperture. Surfaces 160 and 162 defining the cooling aperture 156 of FIG. 8, for example, are configured to direct a jet of cooling air along a respective trajectory 164 to impinge against the panel 118. The trajectory 164 may be substantially parallel and opposite the trajectory 152 in FIG. 6, but for example circumferentially offset.

Figure 12:
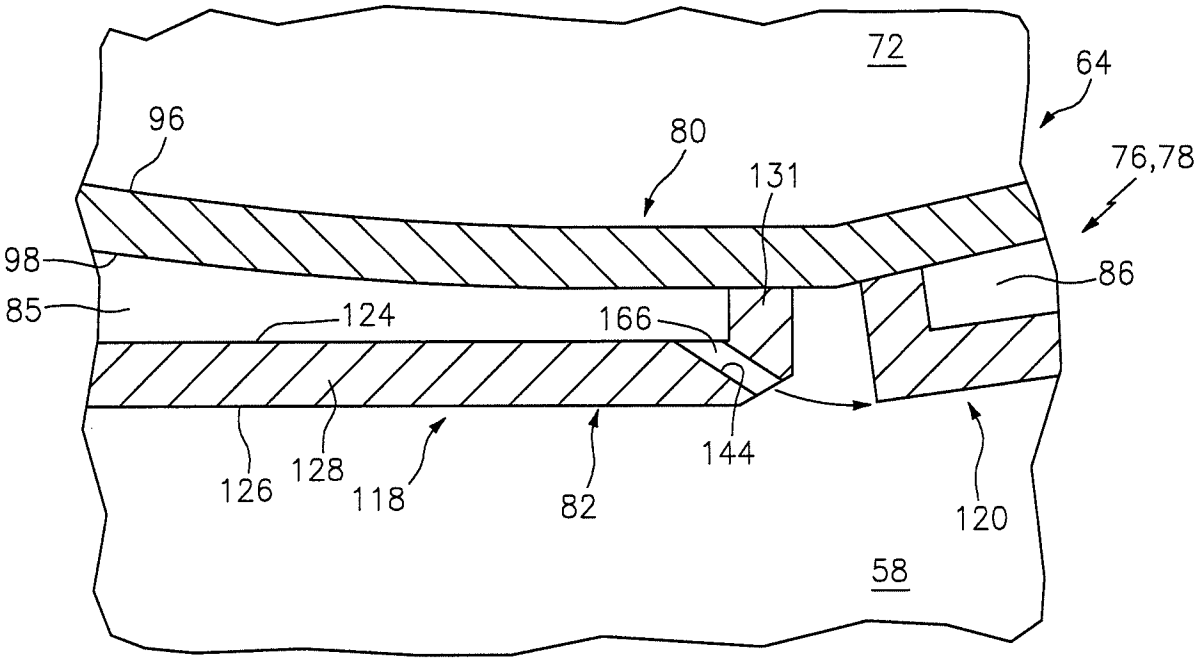

Referring to FIG. 7, each of the aperture surfaces 144 defines a cooling aperture 166 in the panel 118 and, thus, the heat shield 82. Each cooling aperture 166 may extend radially and axially (and/or circumferentially) through the panel base 128 and the axial end rail 131. Alternatively, referring to FIG. 12, one or more of the cooling apertures 166 may extend radially and axially (and/or circumferentially) through and be defined in the panel base 128. One or more of the cooling apertures 166 may also or alternatively extend axially (and/or circumferentially) through and be defined in the axial end rail 131 in a similar manner as illustrated in FIG. 9.

Referring again to FIG. 7, one or more of the cooling apertures 166 may each be configured as an impingement aperture. Each aperture surface 144 of FIG. 7, for example, is configured to direct a jet of cooling air along a respective trajectory 168 to impinge against a body such as, for example, a forward portion of a respective one of the panels 120. Alternatively, one or more of the apertures surfaces 144 may be configured to direct a jet of cooling air into the combustion chamber 58 such that the cooling air forms a film against a downstream portion of the heat shield 82; e.g., panels 120.

Referring to FIG. 2, the heat shield 82 of the inner wall 76 circumscribes the shell 80 of the inner wall 76, and defines an inner side of the combustion chamber 58. The heat shield 82 of the outer wall 78 is arranged radially within the shell 80 of the outer wall 78, and defines an outer side of the combustion chamber 58 that is opposite the inner side. The heat shield 82 and, more particularly, each of the panels 118 and 120 may be respectively attached to the shell 80 by a plurality of mechanical attachments 170 (e.g., threaded studs respectively mated with washers and nuts); see also FIG. 4. The shell 80 and the heat shield 82 thereby respectively form the cooling cavities 84-86 in each of the walls 76, 78.

Referring to FIGS. 4, 5 and 9, each cooling cavity 84 is defined radially by and extends radially between the cavity surface 98 and a respective one of the cavities surfaces 122 as set forth above. Each cooling cavity 84 is defined circumferentially by and extends circumferentially between the end rails 132 and 133 of a respective one of the panels 118. Each cooling cavity 84 is defined axially by and extends axially between the rails 110 and 130 of a respective one of the panels 118. In this manner, each cooling cavity 84 may fluidly couple one or more of the cooling apertures 114 with one or more of the cooling apertures 150.

Each cooling cavity 85 is defined radially by and extends radially between the cavity surface 98 and a respective one of the cavities surfaces 124 as set forth above. Each cooling cavity 85 is defined circumferentially by and extends circumferentially between the end rails 132 and 133 of a respective one of the panels 118. Each cooling cavity 85 is defined axially by and extends axially between the rails 110 and 131 of a respective one of the panels 118. In this manner, each cooling cavity 85 may fluidly couple one or more of the cooling apertures 116 with one or more of the cooling apertures 166.

Referring to FIG. 5, respective portions 172-175 of the shell 80 and the heat shield 82 may converge towards one another; e.g., the shell portions 172 and 173 may include concavities. In this manner, a vertical distance between the shell 80 and the heat shield 82 may decrease as each panel 118 extends from the intermediate rail 110 to its axial end rails 130 and 131. A vertical height of each intermediate rail 110, for example, may be greater than vertical heights of the respective axial end rails 130 and 131. The height of each axial end rail 130, 131, for example, is between about twenty percent (20%) and about fifty percent (50%) of the height of the intermediate rail 110. The shell 80 and the heat shield 82 of FIG. 5 therefore may define each cooling cavity 84, 85 with a tapered geometry. However, in other embodiments, one or more of the cooling cavities 84 and/or 85 may be defined with non-tapered geometries as illustrated, for example, in FIG. 2.

Referring to FIG. 4, core air from the plenum 72 is directed into each cooling cavity 84, 85 through respective cooling apertures 114, 116 during turbine engine operation. This core air (e.g., cooling air) may impinge against the respective panel base 128, thereby impingement cooling the panel 118 and the heat shield 82.

The cooling air may flow axially within the respective cooling cavities 84 and 85 from the cooling apertures 114, 116 to the cooling apertures 150, 166. The converging surfaces 98 and 122, 98 and 124 may accelerate the axially flowing cooling air as it flows towards a respective one of the axial end rails 130, 131. By accelerating the cooling air, thermal energy transfer from the heat shield 82 to the shell 80 through the cooling air may be increased.

Referring to FIG. 6, respective cooling apertures 150 may direct substantially all of the cooling air within the cooling cavity 84 into the combustion chamber 58 towards the bulkhead 74. This cooling air may subsequently impinge against the bulkhead 74 (e.g., the heat shield 154) and thereby impingement cooling to the bulkhead 74. The force of the cooling air impinging against the bulkhead 74 may dissipate the kinetic energy of the air, thereby reducing the likelihood that the cool air will mix and react with the relatively hot core air within the combustion chamber 58. As a result, the temperature within an upstream portion of the combustion chamber 58 may be increased to increase turbine engine efficiency and power without, for example, substantially increasing NOx, CO and unburned hydrocarbon (UHC) emissions of the turbine engine 20.

Referring to FIG. 7, respective cooling apertures 166 may direct substantially all of the cooling air within the cooling cavity 85 into the combustion chamber 58 towards the panels 120. This cooling air may subsequently impinge against the panels 120 and thereby impingement cool a downstream portion of the heat shield 82 and, more particularly, upstream edges of the panels 120. The force of the cooling air impinging against the panels 120 may dissipate the kinetic energy of the air, thereby reducing the likelihood that the cooling air will mix and react with the relatively hot core air within the combustion chamber 58. As indicated above, reducing mixing and reactions between the cooling air and the core air may reduce NOx, CO and unburned hydrocarbon (UHC) emissions of the turbine engine 20.

Figure 13:
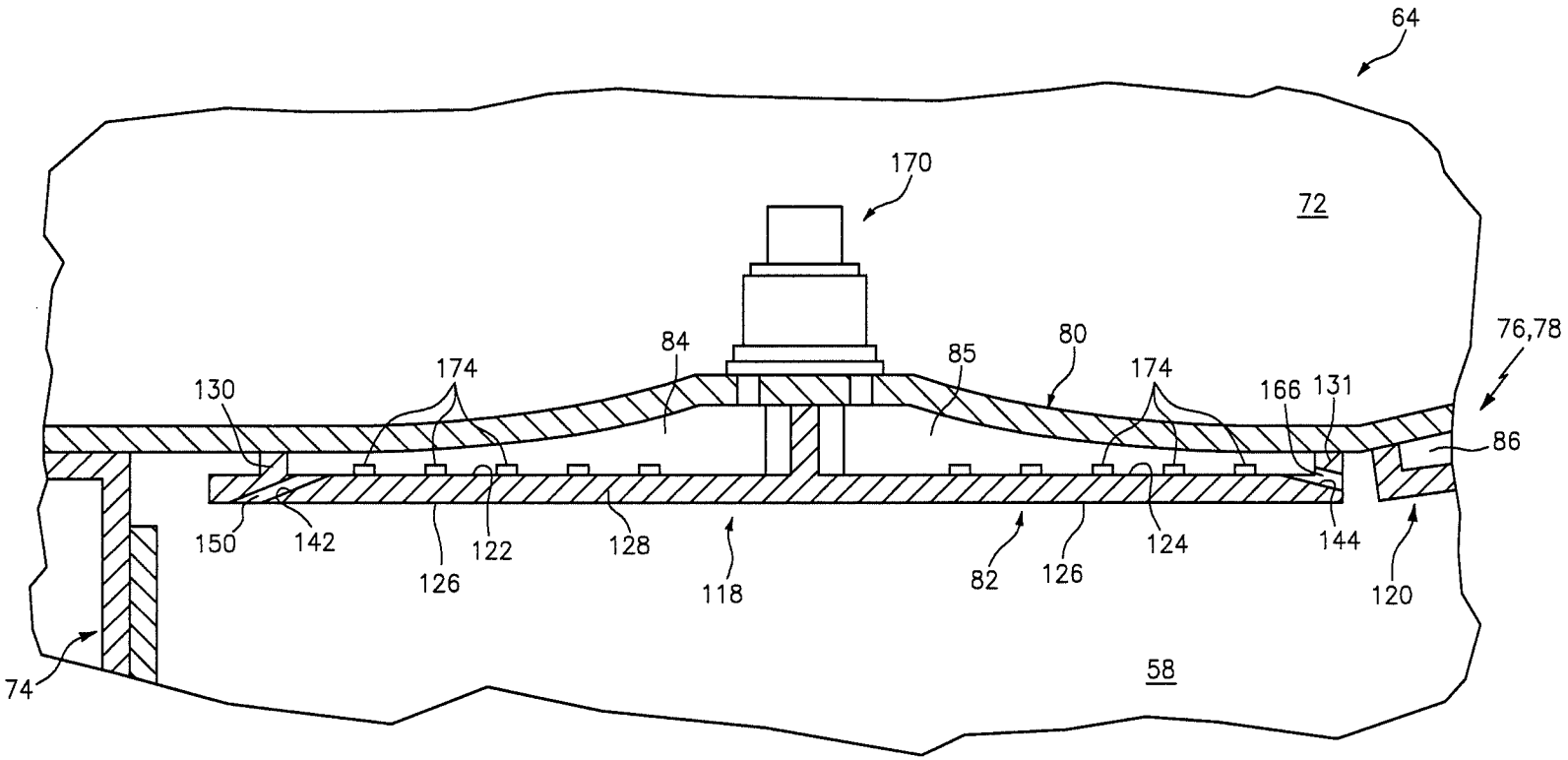

Referring to FIG. 13, in some embodiments, one or more of the walls 76 and 78 may each include one or more cooling elements 174. These cooling elements 174 may be found integral with or attached to the panel base 128. One or more of the cooling elements 174 may further define the cavity surface 122 of each panel 118. One or more of the cooling elements 174 may further define the cavity surface 124 of each panel 118. Each cooling element 174 of FIG. 13 is configured as a cooling pin. One or more of the cooling elements 174, however, may alternatively each be configured as a nodule, a rib, a trip strip or any other type of protrusion or device that aids in the cooling of the wall 76, 78.

The shell 80 and/or the heat shield 82 may each have a configuration other than that described above. In some embodiments, for example, a respective one of the heat shield portions 174 and 175 may have a concavity that defines the cooling cavity tapered geometry with the concavity of a respective one of the shell portions 172 and 173. In some embodiments, a respective one of the heat shield portions 174, 175 may have a concavity rather than a respective one of the shell portions 172, 173. In some embodiments, one or more of the afore-described concavities may be replaced with a substantially straight radially tapering wall. In some embodiments, each panel 118 may define one or more additional cooling cavities with the shell 80. In some embodiments, each panel 118 may define a single cooling cavity (e.g., 84 or 85) with the shell 80, which cavity may taper in a forward or aftward direction. In some embodiments, one or more of the panels 120 may have a similar configuration as that described above with respect to the panels 118. The present invention therefore is not limited to any particular combustor wall configurations.

The terms "forward", "aft", "inner", "outer", "radial", circumferential" and "axial" are used to orientate the components of the turbine engine assembly 62 and the combustor 64 described above relative to the turbine engine 20 and its centerline 22. One or more of these components, however, may be utilized in other orientations than those described above. The present invention therefore is not limited to any particular spatial orientations.

The turbine engine assembly 62 may be included in various turbine engines other than the one described above. The turbine engine assembly 62, for example, may be included in a geared turbine engine where a gear train connects one or more shafts to one or more rotors in a fan section, a compressor section and/or any other engine section. Alternatively, the turbine engine assembly 62 may be included in a turbine engine configured without a gear train. The turbine engine assembly 62 may be included in a geared or non-geared turbine engine configured with a single spool, with two spools (e.g., see FIG. 1), or with more than two spools. The turbine engine may be configured as a turbofan engine, a turbojet engine, a propfan engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. An assembly for a turbine engine, the assembly comprising:

a first body;

a shell;

a first heat shield panel attached to the shell with a tapered cooling cavity between the shell and the first heat shield panel, wherein the first heat shield panel defines a plurality of first cooling apertures, and each of the plurality of first cooling apertures is configured to direct air out of the tapered cooling cavity to impinge against the first body such that substantially all air entering the tapered cooling cavity is directed out of the tapered cooling cavity through the plurality of first cooling apertures to impinge against the first body; and a second body;

wherein the first heat shield panel further defines a second cooling aperture configured to direct air from a second cooling cavity between the shell and the first heat shield panel to impinge against the second body; and wherein the first body comprises a combustor bulkhead, and the second body comprises a second heat shield panel.

2. The assembly of claim 1, wherein the first body defines a plurality of third cooling apertures through which air is directed towards the first heat shield panel.

3. The assembly of claim 2, wherein the plurality of first cooling apertures are circumferentially offset from the plurality of third cooling apertures.

4. The assembly of claim 1, wherein the first heat shield panel includes a rail that partially defines the tapered cooling cavity, and wherein the first heat shield panel defines the plurality of first cooling apertures at the rail.

5. The assembly of claim 4, wherein the rail at least partially defines the plurality of first cooling apertures.

6. The assembly of claim 4, wherein the first heat shield panel further includes a base that partially defines the tapered cooling cavity and at least partially defines the plurality of first cooling apertures.

7. The assembly of claim 1, wherein a surface of the shell and a surface of the first heat shield panel converge towards one another and define at least a portion of the tapered cooling cavity.

8. The assembly of claim 1, wherein the second cooling aperture is one of a plurality of second cooling apertures defined by the first heat shield panel and configured to direct air out of the second cooling cavity to impinge against the second body.

* * * * *